US011598582B2

(12) United States Patent
Zhang et al.

(10) Patent No.: US 11,598,582 B2
(45) Date of Patent: Mar. 7, 2023

(54) SHELL-AND-TUBE HEAT EXCHANGER AND AIR CONDITIONING SYSTEM

(71) Applicant: Carrier Corporation, Palm Beach Gardens, FL (US)

(72) Inventors: Wei Zhang, Shanghai (CN); Bryce Kirk Moore, Broomfield, CO (US); Abbas A. Alahyari, Glastonbury, CT (US); Dhruv Chanakya Hoysall, West Hartford, CT (US); Tobias H. Sienel, Baldwinsville, NY (US); Jack Leon Esformes, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/127,603

(22) Filed: Dec. 18, 2020

(65) Prior Publication Data

US 2021/0190445 A1 Jun. 24, 2021

(30) Foreign Application Priority Data

Dec. 20, 2019 (CN) ..... 201911327784.8

(51) Int. Cl.
*F28D 7/16* (2006.01)
*F28F 9/24* (2006.01)
(Continued)

(52) U.S. Cl.
CPC ..... *F28D 7/1607* (2013.01); *F28F 9/005* (2013.01); *F28F 9/24* (2013.01); *F25B 39/022* (2013.01); *F28F 2009/222* (2013.01)

(58) Field of Classification Search
CPC ..... F25B 39/022; F28D 7/16; F28D 7/1607; F28F 9/005; F28F 9/22; F28F 9/24;
(Continued)

(56) References Cited

U.S. PATENT DOCUMENTS 2,496,301 A * 2/1950 Meixl ..... F28F 9/22 165/134.1
3,990,504 A * 11/1976 Kolthoff, Jr. ..... F28F 27/02 165/271
(Continued)

FOREIGN PATENT DOCUMENTS

EP 3407001 A1 11/2018

OTHER PUBLICATIONS

European Search Report for Application No. 20215424.1; dated May 17, 2021; 7 Pages.

*Primary Examiner* — Eric S Ruppert
*Assistant Examiner* — Hans R Weiland
(74) *Attorney, Agent, or Firm* — Cantor Colburn LLP

(57) ABSTRACT

A shell-and-tube heat exchanger and an air conditioning system. The shell-and-tube heat exchanger includes: a shell provided with a liquid inlet and an vapor outlet, the vapor outlet being disposed at an top portion of the shell; and a heat exchange tube bundle disposed in the shell in an axial direction of the shell; wherein the heat exchange tube bundle includes: a plurality of first heat exchange tubes located at an upper portion, the first heat exchange tubes having a first spacing therebetween; and a plurality of second heat exchange tubes located at a lower portion, the second heat exchange tubes having a second spacing therebetween; the first spacing is different from the second spacing.

9 Claims, 6 Drawing Sheets

(51) Int. Cl.
*F28F 9/22* (2006.01)
*F28F 9/00* (2006.01)
*F25B 39/02* (2006.01)

(58) Field of Classification Search
CPC ..... F28F 2009/222; F28F 2009/224; F28F 2009/226; F28F 2009/228
See application file for complete search history.

(56) References Cited

U.S. PATENT DOCUMENTS

| | | | | |
|---|---|---|---|---|
| 3,991,821 | A * | 11/1976 | Cook | F28F 9/22 165/103 |
| 4,749,166 | A * | 6/1988 | Huenniger | F25B 41/20 251/25 |
| 5,113,928 | A * | 5/1992 | Myers | F28F 9/22 165/103 |
| 9,541,314 | B2 | 1/2017 | Numata et al. | |
| 10,533,772 | B2 * | 1/2020 | Lemon | F24H 9/0063 |
| 2008/0041096 | A1 | 2/2008 | Sakashta et al. | |
| 2015/0330712 | A1 * | 11/2015 | Losada | F28D 7/16 165/103 |
| 2017/0146307 | A1 * | 5/2017 | Gosioco | F28F 9/22 |
| 2017/0153049 | A1 * | 6/2017 | Kondo | F28D 7/163 |

* cited by examiner

SHELL-AND-TUBE HEAT EXCHANGER AND AIR CONDITIONING SYSTEM

FOREIGN PRIORITY

This application claims priority to Chinese Patent Application No. 201911327784.8, filed Dec. 20, 2019, and all the benefits accruing therefrom under 35 U.S.C. § 119, the contents of which in its entirety are herein incorporated by reference.

TECHNICAL FIELD

The present application relates to the field of air conditioning, and more particularly, the present application relates to an air conditioning system and a shell-and-tube heat exchanger for the same.

BACKGROUND

An air conditioning device belongs to a technical field that has been very maturely developed, and it plays a role of regulating air temperature and humidity. Generally speaking, an air conditioning device includes components such as a compressor, a throttling component, and heat exchangers serving as a condenser and an evaporator respectively. The heat exchanger provides a heat exchange space for a refrigerant and an external fluid. Shell-and-tube heat exchangers, as a common type of heat exchanger, have the advantage of high heat exchange performance. However, at the same time, the problem of alleviating liquid carryover is an important challenge in the structural design of shell-and-tube heat exchangers, since such a phenomenon will seriously affect the performance of the compressor, and will further lead to a decrease in system energy efficiency coefficient.

Taking an evaporator as an example, a refrigerant evaporates from a liquid phase into a gas phase in a shell-and-tube heat exchanger, and releases its latent heat. At this point, the shell-and-tube heat exchanger has a heat exchange tube bundle installed at a lower portion and an empty space at an upper portion. A conventional heat exchange tube bundle includes a plurality of heat exchange tubes having the same size and spacing, which are arranged in a staggered manner. In this case, due to the small tube spacing and tube size, a part of the refrigerant will form a medium jet. Such a medium jet typically has a jet velocity of 3-4 m/s, or even as high as 9-10 m/s. At the same time, it also has a large jet inclination. For these two reasons, a part of the refrigerant droplets are ejected into an vapor outlet of the shell-and-tube heat exchanger at a high velocity, resulting in the liquid carryover.

In existing products, relatively conservative designs are usually chosen to alleviate the problem of liquid carryover, such as by reducing the number of heat exchange tubes in the heat exchange tube bundle, or reserving a larger upper empty space, which will also cause a certain degree of waste in design. As another common solution to the problem of liquid carryover, a baffle for vapor outlet is used, which can effectively block the medium jet and prevent it from directly entering the vapor outlet. However, while the aforementioned problem is alleviated by the baffle for vapor outlet, excessive pressure loss of the gas-phase refrigerant may be caused instead, which in turn also affects the system performance.

SUMMARY

The present application aims to provide a shell-and-tube heat exchanger and an air conditioning system in order to at least solve or alleviate some of the problems in the related art.

In order to achieve at least one object of the present application, according to one aspect of the present application, a shell-and-tube heat exchanger is provided, which includes: a shell provided with a liquid inlet and an vapor outlet, the vapor outlet being disposed at an top portion of the shell; and a heat exchange tube bundle disposed in the shell in an axial direction of the shell; wherein the heat exchange tube bundle includes: a plurality of first heat exchange tubes located at an upper portion, the first heat exchange tubes having a first spacing therebetween; and a plurality of second heat exchange tubes located at a lower portion, the second heat exchange tubes having a second spacing therebetween; wherein the first spacing is different from the second spacing.

Optionally, the first spacing is larger than the second spacing, so that a jet inclination and/or a jet velocity of a medium jet at the first spacing is smaller than a jet inclination and/or a jet velocity of the medium jet at the second spacing; or the first spacing is smaller than the second spacing, so that a medium jet is at least partially blocked by the plurality of the first heat exchange tubes.

Optionally, the first spacing is increased by reducing an arrangement density of the plurality of the first heat exchange tubes, and/or by increasing a horizontal pitch plurality of the of the first heat exchange tubes, and/or by increasing a vertical pitch between the plurality of the first heat exchange tubes; the first spacing is decreased by increasing an arrangement density of the plurality of the first heat exchange tubes, and/or by decreasing a horizontal pitch of the plurality of the first heat exchange tubes, and/or by decreasing a vertical pitch between the plurality of the first heat exchange tubes.

Optionally, the plurality of the first heat exchange tubes located on the upper portion of the heat exchange tube bundle are arranged in one or more rows from top to bottom, and the number of rows of the first heat exchange tubes is not larger than the number of rows of the plurality of the second heat exchange tubes.

Optionally, the first spacing is a vertical spacing between a plurality of the first heat exchange tubes in a same column, or a horizontal spacing between a plurality of the first heat exchange tubes in a same row, or a diagonal spacing between the first heat exchange tubes in a staggered arrangement.

Optionally, the first heat exchange tubes are a plurality of heat exchange tubes having the same diameter or a plurality of heat exchange tubes having different diameters.

In order to achieve at least one object of the present application, according to another aspect of the present application, a shell-and-tube heat exchanger is further provided, which includes: a shell provided with a liquid inlet and an vapor outlet, the vapor outlet being disposed at an upper portion of the shell; a heat exchange tube bundle disposed in the shell in an axial direction of the shell; and a baffle assembly disposed at an entrance of the vapor outlet and having a baffle capable of adjusting a blocking area.

Optionally, the baffle assembly includes: a bracket, a first end of which is fixed to the vapor outlet, and a second end of which extends from the vapor outlet toward the internal portion of the heat exchanger; a baffle, which is connected to the second end of the bracket and driven to change the blocking area; and a connecting rod, two ends of which are connected to the bracket and the baffle respectively, wherein a reciprocating movement of the connecting rod with respect to the bracket causes a rotational movement of the baffle with respect to the bracket.

Optionally, the baffle includes a solid plate in the middle and a perforated plate arranged on an outer periphery of the solid plate.

Optionally, the baffle is divided into a plurality of baffle sections in a radial direction, and the baffle assembly includes: a plurality of connecting rods, each of which being connected to the bracket and each of the baffle sections of the baffle respectively; wherein a reciprocating movement of each of the connecting rods with respect to the bracket causes a independently rotational movement of each of the baffle sections with respect to the bracket.

In order to achieve at least one object of the present application, according to yet another aspect of the present application, an air conditioning system is further provided, which includes a shell-and-tube heat exchanger as described above.

According to the shell-and-tube heat exchanger and the air conditioning system of the present application, on the one hand, by changing the spacings between upper heat exchange tubes with respect to the spacings between lower heat exchange tubes, the jet inclination and/or the jet velocity of the medium jet are effectively decreased, or the jet is effectively blocked so that the problem of liquid carryover is alleviated, thereby improving the compressor performance and the system performance; on the other hand, by providing a baffle assembly with a variable blocking area, the blocking area is adjusted as needed according to a refrigerant state in the shell-and-tube heat exchanger, so that a balance between the liquid carryover and an excessive pressure loss is effectively achieved, thereby improving the system performance.

DETAILED DESCRIPTION

Figure 1:
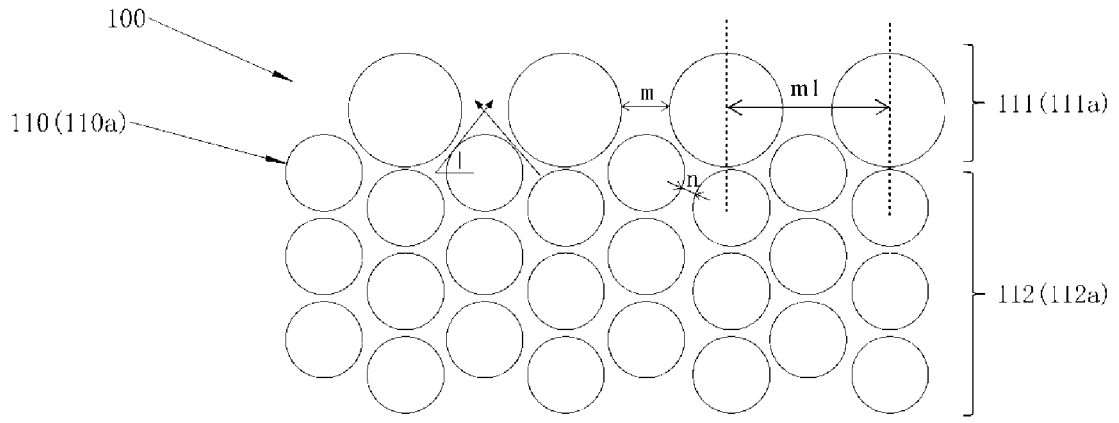
FIG. 1 is a schematic cross-sectional side view of a first embodiment of a shell-and-tube heat exchanger of the present application.

First, it should be noted that the components, working principle, characteristics, and advantages of the shell-and-tube heat exchanger and the air conditioning system according to the present application will be described below by way of example, but it should be understood that all the description is given by way of illustration only and should not be construed as limiting the present disclosure in any way.

In addition, for any single technical feature described or implied in the embodiments mentioned herein, or any single technical feature shown or implied in individual drawings, this application still allows these technical features (or equivalents thereof) to be further arbitrarily combined or added or deleted without any technical obstacle, thereby obtaining more other embodiments of the present application that may not have been directly mentioned herein.

Those skilled in the art should also know that the air conditioning system proposed in the present application does not refer to, in a narrow sense, an air conditioner having an outdoor refrigerating/heating unit and an indoor heat exchange unit used in a building in the industry. Rather, it should be construed as a type of thermodynamic system having an air conditioning function, which when driven by various power sources (for example, electric power), exchanges heat with air at a location to be adjusted through a phase change of a refrigerant in the system. For example, when the air conditioning system is used for heating, ventilating and air conditioning in a building, it may be a refrigeration system having a refrigerating function only, or it may be a heat pump system having both refrigerating and heating capabilities. As another example, when the air conditioning system is used in a cold chain field, it may be a transportation refrigeration system or a refrigeration/freezing system. However, no matter what type the air conditioning system is, the heat exchanger will be applicable to the concept of the present application only when the shell-and-tube heat exchanger described herein is used as the heat exchanger in the air conditioning system.

The term "jet inclination" as defined herein refers to an inclined angle of the refrigerant in the air-conditioning system boiling in the shell-and-tube heat exchanger when ejected between top heat exchange tubes of the heat exchange tube bundle in a working state. The inclined angle is typically represented by an angle between the direction of ejected medium jet and a horizontal plane.

In addition, the term "spacing" as defined herein is a gap between adjacent heat exchange tubes, via which the medium jet may flow or be ejected. Considering a relative arrangement of a plurality of heat exchange tubes, the spacing may be a horizontal spacing, a vertical spacing, or a diagonal spacing. As one of the ways of obtaining the spacing, a straight connection line may be drawn between geometric centers of adjacent heat exchange tubes, and a line segment between intersection points of the straight line and individual heat exchange tubes is the spacing.

Analogously, the term "pitch" as defined herein is a distance between vertical auxiliary lines or horizontal auxiliary lines of the geometric centers of adjacent heat exchange tubes, which may be presented as a horizontal pitch m1 or a vertical pitch m2 to assist in calculating the spacing defined in the present application. For example, the diagonal spacing may be obtained by performing vector processing on the horizontal pitch m1 and the vertical pitch m2.

Figure 5:
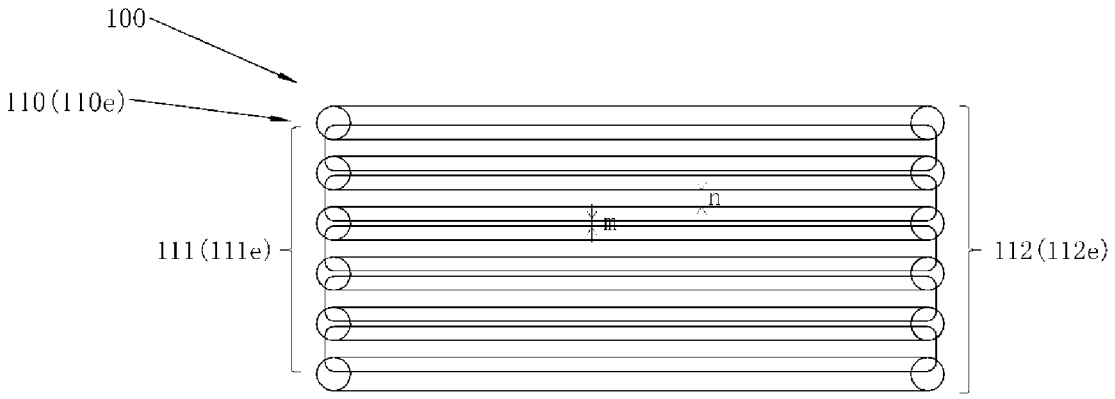
FIG. 5 is a schematic top view of a fifth embodiment of a shell-and-tube heat exchanger of the present application.
Figure 6:
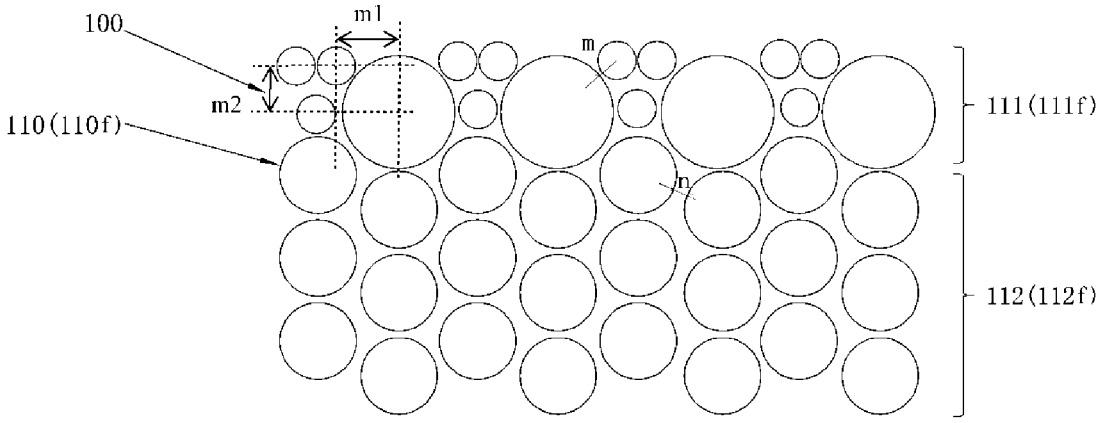
FIG. 6 is a schematic cross-sectional side view of a sixth embodiment of a shell-and-tube heat exchanger of the present application.
Figure 7:
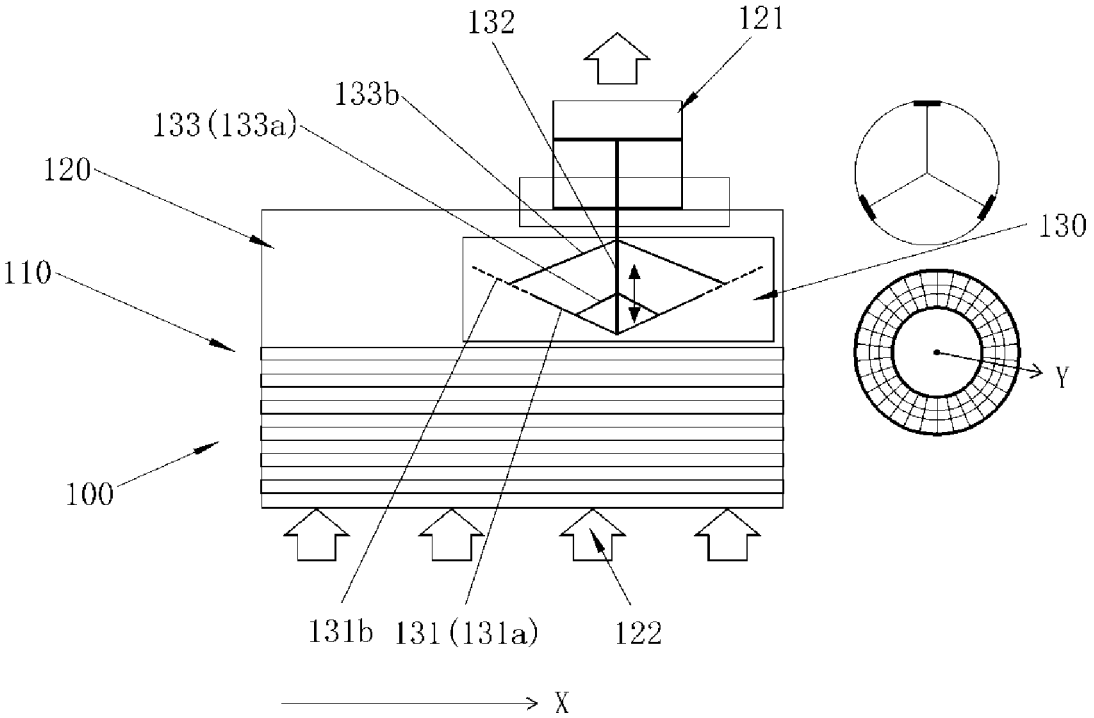
FIG. 7 is a schematic partial front view of the sixth embodiment of the shell-and-tube heat exchanger of the present application, wherein a baffle assembly is in a first working state.
Figure 8:
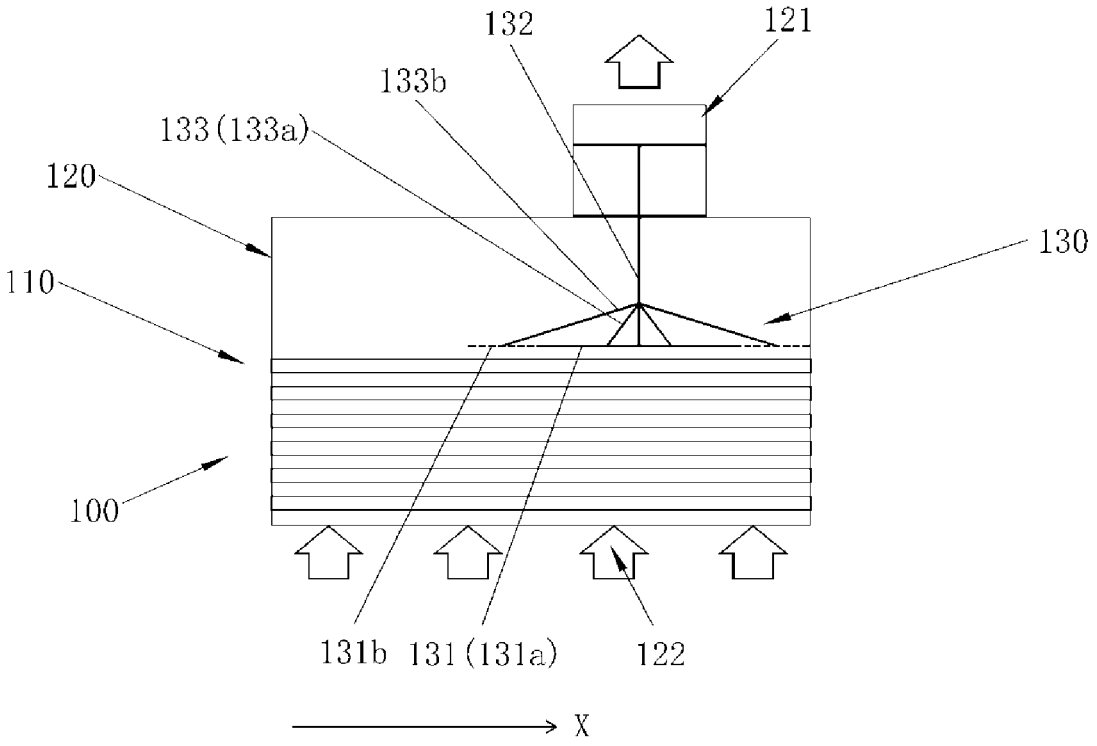
FIG. 8 is a schematic partial front view of the sixth embodiment of the shell-and-tube heat exchanger of the present application, wherein the baffle assembly is in a second working state.
Figure 9:
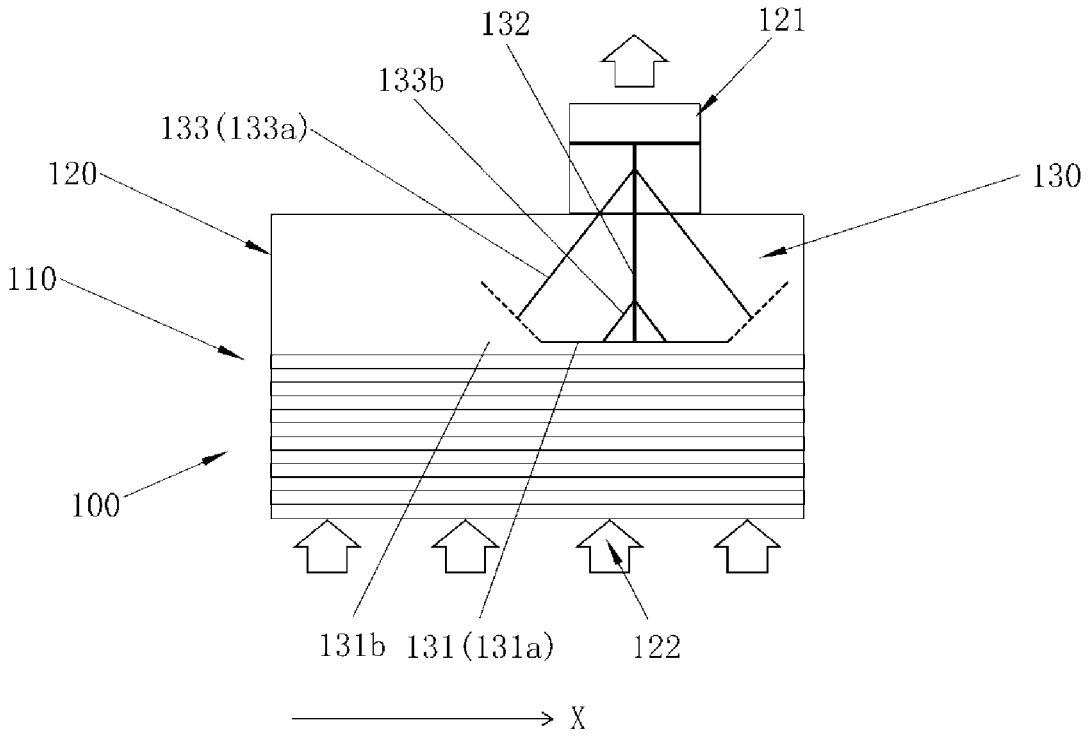
FIG. 9 is a schematic partial front view of the sixth embodiment of the shell-and-tube heat exchanger of the present application, wherein the baffle assembly is in a third working state.

Returning to the present application, a plurality of embodiments of different structures and arrangements of a tube bundle of a shell-and-tube heat exchanger according to the present application are shown schematically in FIGS. 1 to 6; and a substantial structural configuration of an embodiment of a shell-and-tube heat exchanger with a baffle assembly having a variable blocking area according to the present application is only schematically shown in FIGS. 7 to 9 from different angles. The technical solution of the present disclosure will be described in detail below with reference to the above-mentioned drawings.

Referring to FIG. 1, the present application herein provides an embodiment of a shell-and-tube heat exchanger, wherein the structure is shown in a cross-sectional side view. The shell-and-tube heat exchanger 100 includes a shell 120 and a heat exchange tube bundle 110 disposed in the shell 120 in an axial direction X. Of course, the shell-and-tube heat exchanger 100 may also include more mature and conventional structures from the related art, such as support plates that support two ends of the heat exchange tube bundle, and a sight glass for observing an internal operating state, which will not be described herein again.

Although not shown in the drawing, the shell-and-tube heat exchanger 100 generally has a cylindrical structure, and a liquid inlet 122 and an vapor outlet 121 are disposed on a cylindrical circumferential wall face for liquid-phase refrigerant to flow in and for gas-phase refrigerant (probably mixed with a small amount of droplets) to flow out. In an installed state, the vapor outlet 121 is typically disposed on a top wall face of the shell 120, and the liquid inlet 122 is typically disposed on a bottom wall face of the shell 120. In addition, a liquid collecting portion communicating with the heat exchange tube bundle 110 is usually provided at each of both ends of the cylindrical structure of the shell-and-tube heat exchanger 100 for the inflow and outflow of the medium in the tube bundle.

More critically, the heat exchange tube bundle 110 in the present application includes a plurality of first heat exchange tubes 111 located at an upper portion and a plurality of second heat exchange tubes 112 located at a lower portion. The plurality of the first heat exchange tubes 111 have a first spacing m therebetween, the plurality of the second heat exchange tubes 112 have a second spacing n therebetween, and the first spacing m is different from the second spacing n. Under this arrangement, by changing the spacings between the upper heat exchange tubes 111 with respect to the spacings between the lower heat exchange tubes 112, a jet inclination 1 and/or a jet velocity of a medium jet can be effectively reduced, or the jet can be effectively blocked to alleviate the problem of liquid carryover, further improving the compressor performance and the system performance.

It should be known that in the above embodiment, different order numbers are used to name the first heat exchange tubes 111 and the second heat exchange tubes 112 mainly for the purpose of distinguishing their installation positions, and they are not required to be different in terms of structure or size. As long as the concept of the present application is met, that is, the object of having different gaps between the first heat exchange tubes 111 and the second heat exchange tubes 112 is achieved, any modification should be included in the scope of protection of the present application. For example, the object can be achieved by improving the structure of the heat exchange tube, or by improving its arrangement, or even by changes in other aspects. Similarly, the first heat exchange tubes 111 are also not necessarily required to be a plurality of heat exchange tubes having the same diameter, and they may also be a plurality of heat exchange tubes having different diameters. The above-mentioned examples of improvements made to the heat exchange tubes from different aspects are in line with the spirit of the present application, the first heat exchange tubes and the second heat exchange tubes should not be restrictively required to be necessarily distinguished in structure, and the set of the type of heat exchange tubes represented by the first heat exchange tubes are also not required to be necessarily completely identical in structure.

Therefore, on the basis of the above embodiment, several modifications may also be made to the heat exchange tube bundle in the shell-and-tube heat exchanger in order to obtain similar technical effects or additional technical effects, which will be exemplarily described below.

For example, for a first case where the first spacing m is different from the second spacing n, that is, when the first spacing m is set to be larger than the second spacing n, a jet inclination 1 and/or a jet velocity of the medium jet at the first spacing m in the shell-and-tube heat exchanger 100 is smaller than a jet inclination 1 and/or a jet velocity of the medium jet at the second spacing n, in such a way that the medium jet is ejected toward the two sides of the shell and as far away from the vapor outlet at the top as possible, or that the velocity of the medium jet is insufficient for the medium jet to be brought into the vapor outlet by the gas-phase refrigerant, thereby achieving the effect of reducing the liquid carryover.

For another example, for a second case where the first spacing m is different from the second spacing n, that is, when the first spacing m is set to be smaller than the second pitch n, a smaller spacing means a space for the medium jet to be ejected toward the outside becomes smaller, so the medium jet is at least partially blocked by the first heat exchange tubes 111, thereby achieving the effect of reducing the liquid carryover.

The large spacing or small spacing mentioned in the above embodiment can be implemented in various ways, which will be exemplarily explained as follows.

For example, the first spacing m may be increased by reducing an arrangement density of the plurality of the first heat exchange tubes 111, or the first spacing m may be increased by increasing a horizontal pitch m1 of the first heat exchange tubes 111, or the first spacing m may be increased by increasing a vertical pitch m2 of the first heat exchange tubes 111; of course, the three methods may also be combined arbitrarily, or other technical means not described herein but also in line with the spirit of the present application may be used. Similarly, the first spacing m may be decreased by increasing the arrangement density of the plurality of the first heat exchange tubes 111, or the first spacing m may be decreased by decreasing the horizontal pitch m1 of the first heat exchange tubes 111, or the first spacing m may be decreased by decreasing the vertical pitch m2 of the first heat exchange tubes 111; of course, the three methods may also be combined arbitrarily, or other technical means not described herein but also in line with the spirit of the present application may be used.

For another example, a direction of the change of the spacing mentioned in the above embodiment is not limited strictly, as long as the object of blocking the medium jet or affecting its flow velocity and flow direction can be finally achieved. Therefore, as already mentioned above, the first spacing m may either represent the vertical spacing between a plurality of first heat exchange tubes 111 in the same column, or the horizontal spacing between a plurality of first heat exchange tubes 111 in the same row, or the diagonal spacing between the first heat exchange tubes in a staggered arrangement.

In addition, one of the main points of spacing change of the heat exchange tube bundle is the comparison and change of the spacing, that is, it is expected that the spacing of the upper heat exchange tubes is changed relative to the spacing of the lower heat exchange tubes. Only then can the medium jet generated from the lower part of the liquid-phase refrigerant be affected. Therefore, in order to ensure that this effect can be achieved, a plurality of first heat exchange tubes 111 located on the upper portion of the heat exchange tube bundle 110 may be arranged in one or more rows from top to bottom, but at the same time, the number of rows of the upper first heat exchange tubes preferably does not exceed the number of rows of lower second heat exchange tubes.

In the following, a number of specific design modifications of the heat exchanger tube bundle made on the basis of the aforementioned design methods will be enumerated, each of which can achieve similar technical effects or additional technical effects.

Referring again to FIG. 1, it can be known that the heat exchange tube bundle 110*a* used for the exemplary description in the foregoing adopts a solution of increasing the first spacing m. Specifically, the first spacing m is increased by reducing the arrangement density of the plurality of the first heat exchange tubes 111*a* and increasing the horizontal pitch (herein, a connection line between circle centers of adjacent circular tubes) of the first heat exchange tubes 111*a* relative to the second heat exchange tubes 112*a* simultaneously, thereby achieving the object of decreasing the jet inclination 1 and/or the jet velocity, and finally improving the problem of liquid carryover.

Figure 2:
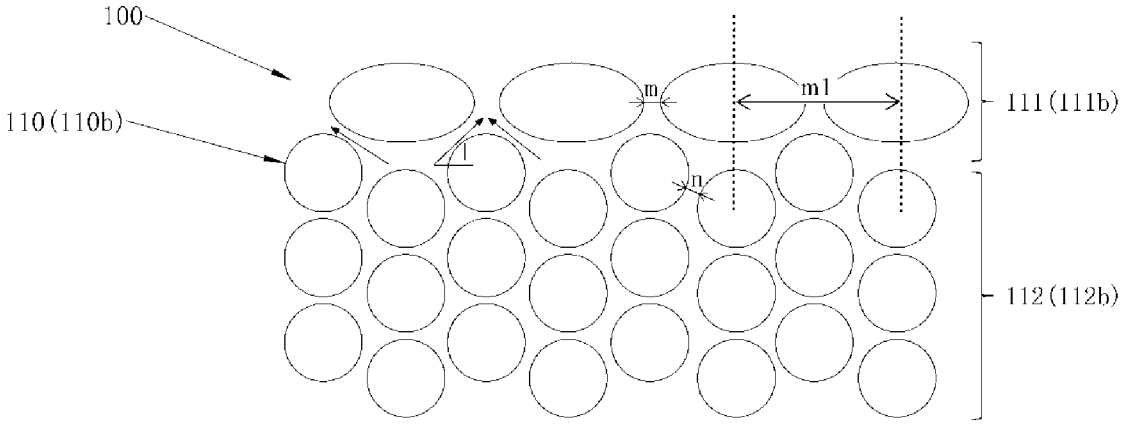
FIG. 2 is a schematic cross-sectional side view of a second embodiment of a shell-and-tube heat exchanger of the present application.
Figure 3:
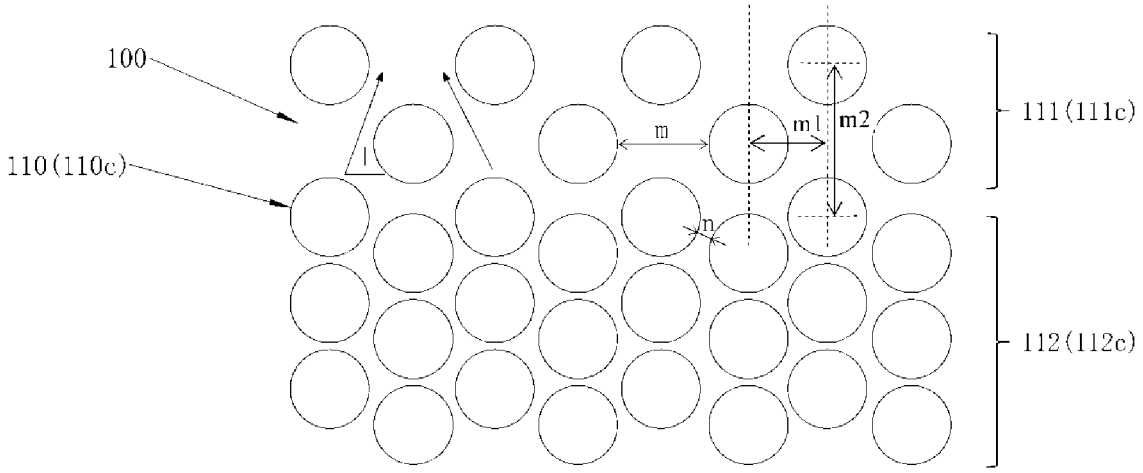
FIG. 3 is a schematic cross-sectional side view of a third embodiment of a shell-and-tube heat exchanger of the present application.

Turning to FIG. 2, the heat exchange tube bundle 110*b* in this embodiment also adopts a solution of increasing the first spacing m. Specifically, the first spacing m is increased by reducing the arrangement density of the plurality of the first heat exchange tubes 111*b* and increasing the horizontal pitch (herein, a connection line between geometric centers of adjacent oval tubes) of the first heat exchange tubes 111*b* relative to the second heat exchange tubes 112*b* simultaneously, thereby achieving the object of decreasing the jet inclination 1 and/or the jet velocity, and finally improving the problem of liquid carryover.

Referring again to FIG. 3, the heat exchange tube bundle 110*c* in this embodiment also adopts a solution of increasing the first spacing m. In this embodiment, the horizontal and vertical pitches of the first heat exchange tubes 111*c* relative to the second heat exchange tubes 112*b* are affected by changing the vertical arrangement density, and the first spacing m is finally increased, thereby achieving the object of decreasing the jet inclination 1 and/or the jet velocity, and finally improving the problem of liquid carryover.

Figure 4:
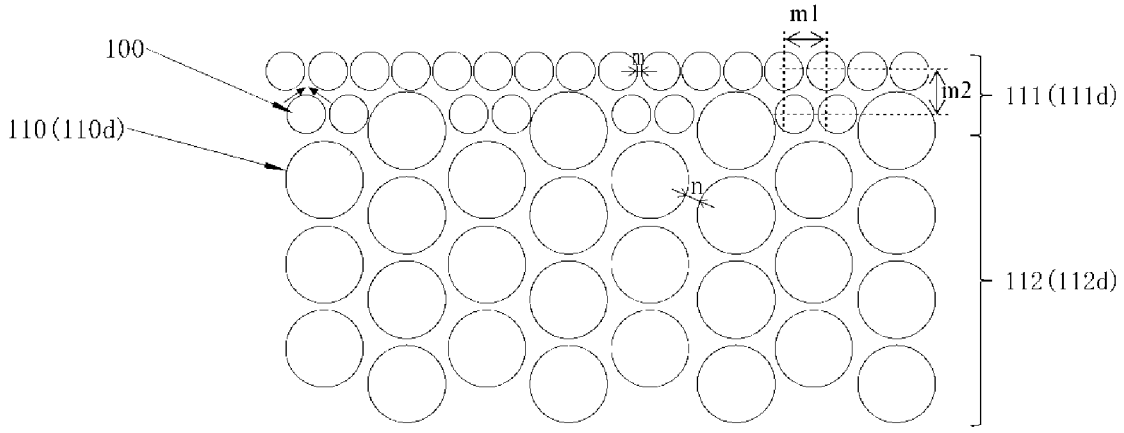
FIG. 4 is a schematic cross-sectional side view of a fourth embodiment of a shell-and-tube heat exchanger of the present application.

With continued reference to FIG. 4, the heat exchange tube bundle 110*d* in this embodiment adopts a solution of decreasing the first spacing m. Specifically, the first spacing m is decreased by increasing the arrangement density of the plurality of the first heat exchange tubes 111*d* and decreasing the horizontal pitch (herein, a connection line between circle centers of adjacent circular tubes) of the first heat exchange tubes 111*d* relative to the second heat exchange tubes 112*d* simultaneously, thereby achieving the object of blocking the medium jet from being ejected toward the outside, and finally improving the problem of liquid carryover.

Referring next to FIG. 5 which is schematic top view of a shell-and-tube heat exchanger, the heat exchange tube bundle 110*e* in this embodiment also adopts a solution of decreasing the first spacing m. Specifically, although the arrangement density of the first heat exchange tubes 111*e* here is lower than that of the second heat exchange tubes 112*e*, considering their own profiled contour design (herein, presented as rectangular heat exchange tube), if the second heat exchange tubes 112*e* (herein, presented as circular heat exchange tube) also adopt this type of structure, the arrangement density of the first heat exchange tubes 111*e* will still be relatively high so that the first spacing m is decreased, thereby achieving the object of blocking the medium jet from being ejected toward the outside, and finally improving the problem of liquid carryover.

Finally, referring to FIG. 6, the heat exchange tube bundle 110*f* in this embodiment adopts a solution of decreasing the first spacing m. In this embodiment, the first spacing m of the first heat exchange tubes 111*f* is a diagonal spacing, the second spacing of the second heat exchange tubes 112*f* is a diagonal spacing n, and m is smaller than n. Specifically, the first heat exchange tubes 111*f* are designed to have a variable diameter so that the first heat exchange tubes 111*f* have both a larger diameter and a smaller diameter than the second heat exchange tubes 112*f* In this combined arrangement, the first spacing m is decreased by increasing the arrangement density of the plurality of first heat exchange tubes 111*f* and reducing the horizontal and vertical pitches of the first heat exchange tubes 111*f* relative to the second heat exchange tubes 112*f* simultaneously, thereby achieving the object of blocking the medium jet from being ejected toward the outside, and finally improving the problem of liquid carryover.

Any of the foregoing embodiments or a combination thereof can effectively alleviate or improve the problem of liquid carryover in the shell-and-tube heat exchanger from the perspective of the heat exchange tube bundle. On this basis, more embodiments are provided by the present application to alleviate or improve the problem of liquid carryover in the shell-and-tube heat exchanger from other perspectives.

Referring to FIGS. 7 to 9, there is provided another embodiment of a shell-and-tube heat exchanger, wherein the structure is shown in a cross-sectional side view. The shell-and-tube heat exchanger 100 includes a shell 120 and a heat exchange tube bundle 110 disposed in the shell 120 in an axial direction X. Of course, the shell-and-tube heat exchanger 100 may also include more mature and conventional structures from the related art, such as support plates that support two ends of the heat exchange tube bundle, and a sight glass for observing an internal operating state, which will not be described herein again.

The illustrated shell-and-tube heat exchanger 100 has a cylindrical structure, and a liquid inlet 122 and an vapor outlet 121 are disposed on a cylindrical circumferential wall face for liquid-phase refrigerant to flow in and for gas-phase refrigerant (probably mixed with a small amount of droplets) to flow out. In an installed state, the vapor outlet 121 is typically disposed on an upper wall face of the shell 120, and the liquid inlet 122 is typically disposed on a lower wall face of the shell 120. In addition, a liquid collecting portion communicating with the heat exchange tube bundle 110 is usually provided at each of both ends of the cylindrical structure of the shell-and-tube heat exchanger 100 for the inflow and outflow of the medium in the tube bundle.

More critically, the shell-and-tube heat exchanger 100 in the present application also has a baffle assembly 130 which is disposed at an entrance of the vapor outlet 121 and has a baffle 131 capable of adjusting a blocking area. Under this arrangement, by providing the baffle assembly 130 having a variable blocking area, the blocking area is adjusted as needed according to a refrigerant state in the shell-and-tube heat exchanger 100, so that a balance between the liquid carryover and an excessive pressure loss is effectively achieved, thereby improving the system performance.

On the basis of the foregoing embodiments, several modifications may also be made to the various components of the baffle assembly of the shell-and-tube heat exchanger or the relationship of connection positions thereof, in order to obtain other technical effects, which will be described by way of example below.

For example, with continued reference to FIGS. 7 to 9, as a specific structural form of the baffle assembly, it includes a bracket 132, a baffle 131 and a connecting rod 133. The bracket 132 serves as a basic member of the entire baffle assembly, a first end thereof may be fixed to an inner wall of the vapor outlet 121 by three legs in a manner as shown in the drawing, and a second end thereof may be columnar and extends into an inner cavity of the shell-and-tube heat exchanger from the interior of the vapor outlet 121. The baffle 131 is connected to the second end of the bracket 132 and may be driven to change the blocking area. Although the blocking area is pivotally changed in the illustrated embodiment, under the teaching of this application, the blocking area may also be changed by means of translating or sliding, which should also be included in the scope of this application. In addition, as a driving transmission member, the connecting rod 133 is pivotally connected to the bracket 132 and the baffle 131 respectively. In this case, a reciprocating movement of the connecting rod 133 with respect to the bracket 132 will be converted into a rotational movement of the baffle 131 with respect to the bracket 132, thereby realizing the change of the baffle 131's blocking area to the medium jet, so that the blocking area can be increased when the medium jet is strong so as to avoid liquid carryover, and the blocking area can be decreased when the medium jet is relatively gentle so as to reduce pressure loss. In summary, a balance between the two is effectively achieved.

Similarly, for the purpose of both alleviating the liquid carryover and reducing the pressure loss, the baffle 131 may also be provided in sections. For example, it has a middle solid plate section 131*a* divided in a radial direction Y and a perforated plate section 131*b* arranged on an outer periphery of the solid plate section 131*a*. Under this arrangement, the medium jet that is directly ejected toward the very middle of the entrance side of the vapor outlet will be directly blocked, while for the medium jet that is indirectly ejected toward the outer periphery of the entrance side of the vapor outlet, such a throttling blocking as the perforated plate may be used.

Furthermore, in order to provide section-wise control for the baffle 131 having a plurality of baffle sections 131*a*, 131*b*, a plurality of connecting rods 133*a*, 133*b* may also be provided correspondingly, and each of the connecting rods 133*a*, 133*b* is pivotally connected to the bracket 132 and each of the baffle sections 131*a*, 131*b*, respectively. Under this arrangement, a reciprocating movement of each connecting rod 133*a*, 133*b* with respect to the bracket 132 is independently converted into a rotational movement of each baffle section 131*a*, 131*b* with respect to the bracket 132. This enables a more diverse control of the blocking area and refines its adjustment range.

Referring to FIGS. 7 to 9, the baffle assembly is shown in different working states, respectively. In FIG. 7, the baffle 131 is in a partially open state as a whole, thereby partially blocking the medium jet. In FIG. 8, the baffle 131 is in a maximum open state within its adjustment range as a whole, thereby achieving a maximum blocking of the medium jet. In FIG. 9, the solid plate section 131*a* of the baffle 131 is in a maximum open state within its adjustment range, and the perforated plate section 131*b* thereof is in a partially open state, thereby achieving a maximum blocking of the medium jet in the middle portion and a partial blocking of the medium jet in the peripheral part. This arrangement achieves an optimization of the balance between solving the problem of liquid carryover and solving the problem of pressure loss through these exemplary adjustments or other adjustments not shown but equally achievable.

In addition, although not shown in the drawings, the present application also provides an embodiment of an air conditioning system. The air conditioning system may be provided with any of the embodiments of the shell-and-tube heat exchanger 100 or a combination thereof according to application requirements, and thus may also have the technical effects brought by the foregoing technical solutions, which therefore will not be described again.

It should be noted that the shell-and-tube heat exchanger and other parts of the air-conditioning system provided according to the present application may be separately designed, manufactured, and sold, or they may be assembled and then sold as an entirety. Either the single pieces formed before the combination or the entirety formed after the combination will each fall within the scope of protection of the present application.

In the above examples, the shell-and-tube heat exchanger and the air conditioning system of the present application are mainly described. Although only some of the embodiments of the present application have been described, those skilled in the art should understand that the present application may be implemented in many other forms without departing from the spirit and scope thereof. Therefore, the illustrated examples and embodiments should be regarded as illustrative rather than restrictive, and the present application may cover various modifications and replacements without departing from the spirit and scope of the present application as defined by the appended claims.

What is claimed is:

1. A shell-and-tube heat exchanger, comprising:

a shell provided with a liquid inlet and an vapor outlet, the vapor outlet being disposed at an upper portion of the shell;

a heat exchange tube bundle disposed in the shell in an axial direction of the shell; and a baffle assembly disposed at an entrance of the vapor outlet and having a baffle capable of adjusting a blocking area;

wherein the baffle assembly comprises:

a bracket, a first end of which is fixed to the vapor outlet, and a second end of which extends from the vapor outlet toward the internal portion of the heat exchanger;

a baffle, which is connected to the second end of the bracket and driven to change the blocking area; and a connecting rod, two ends of which are connected to the bracket and the baffle respectively, wherein a reciprocating movement of the connecting rod with respect to the bracket causes a rotational movement of the baffle with respect to the bracket.

2. The shell-and-tube heat exchanger of claim 1:

wherein the heat exchange tube bundle comprises a plurality of first heat exchange tubes located at an upper portion, the first heat exchange tubes having a first spacing therebetween; and a plurality of second heat exchange tubes located at a lower portion, the second heat exchange tubes having a second spacing therebetween;

wherein the first spacing is different from the second spacing.

3. The shell-and-tube heat exchanger according to claim 2, wherein:

the first spacing is decreased by increasing an arrangement density of the plurality of the first heat exchange tubes, and/or by decreasing a horizontal pitch of the plurality of the first heat exchange tubes, and/or by decreasing a vertical pitch between the plurality of the first heat exchange tubes.

4. The shell-and-tube heat exchanger according to claim 2, wherein the plurality of the first heat exchange tubes located on the upper portion of the heat exchange tube bundle are arranged in one or more rows from top to bottom, and the number of rows of the first heat exchange tubes is not larger than the number of rows of the plurality of the second heat exchange tubes.

5. The shell-and-tube heat exchanger according to claim 2, wherein the first spacing is a vertical spacing between a plurality of the first heat exchange tubes in a same column, or a horizontal spacing between a plurality of the first heat exchange tubes in a same row, or a diagonal spacing between the first heat exchange tubes in a staggered arrangement.

6. The shell-and-tube heat exchanger according to claim 2, wherein the first heat exchange tubes are a plurality of heat exchange tubes having the same diameter or a plurality of heat exchange tubes having different diameters.

7. The shell-and-tube heat exchanger according to claim 1, wherein the baffle comprises a solid plate in the middle and a perforated plate arranged on an outer periphery of the solid plate.

8. The shell-and-tube heat exchanger according to claim 1, wherein the baffle is divided into a plurality of baffle sections in a radial direction, and the baffle assembly comprises: a plurality of connecting rods, each of which being connected to the bracket and each of the baffle sections of the baffle respectively; wherein a reciprocating movement of each of the connecting rods with respect to the bracket causes a independently rotational movement of each of the baffle sections with respect to the bracket.

9. An air conditioning system, comprising: the shell-and-tube heat exchanger according to claim 1.

* * * * *